United States Patent [19]

Zezelj

[11] 4,065,897

[45] Jan. 3, 1978

[54] PRECAST SKELETON SPATIAL MONOLITHIC STRUCTURE

[76] Inventor: Branko Žeželj, Vojvode Misica 43, Belgrade, Yugoslavia

[21] Appl. No.: 486,906

[22] Filed: July 9, 1974

[51] Int. Cl.[2] ..... E04C 3/26

[52] U.S. Cl. ..... 52/227; 52/252; 52/259; 52/263

[58] Field of Search ..... 52/228, 262, 167, 263, 52/227, 726, 229, 728, 252, 259

[56] References Cited

U.S. PATENT DOCUMENTS

| | | | |
|---|---|---|---|
| 1,053,646 | 2/1913 | Roberts | 52/262 |
| 2,618,146 | 11/1952 | Ciarlini | 52/252 |
| 3,261,135 | 7/1966 | Knabe | 52/252 X |
| 3,340,664 | 9/1967 | Reiland | 52/726 |
| 3,495,371 | 2/1970 | Mitchell | 52/252 X |
| 3,553,923 | 1/1971 | Dompas | 52/228 X |
| 3,561,179 | 2/1971 | Young | 52/229 |
| 3,722,159 | 3/1973 | Kessler | 52/252 |
| 3,903,667 | 9/1975 | Zetlin | 52/263 X |

FOREIGN PATENT DOCUMENTS

| | | | |
|---|---|---|---|
| 1,123,984 | 10/1956 | France | 52/228 |
| 567,451 | 3/1924 | France | 52/252 |
| 1,567,855 | 4/1969 | France | 52/228 |
| 612,667 | 11/1960 | Italy | 52/227 |
| 734,770 | 8/1955 | United Kingdom | 52/228 |
| 601,038 | 4/1948 | United Kingdom | 52/227 |
| 250,417 | 8/1969 | U.S.S.R. | 52/167 |
| 206,834 | 12/1967 | U.S.S.R. | 52/167 |

*Primary Examiner*—Leslie Braun

[57] ABSTRACT

A skeleton monolithic structure and method of assembly thereof employing the maxim of providing in that each beam of the structure in the longitudinal and transverse directions thereof, is divided into two channel-forming parts, thus providing ample space for the free threading of steel cables in order to effect the prestressing. The straight-line or linear cables run through the thus formed longitudinally and transversely extending channels, while in the locations for columns they are pulled through suitable holes previously prepared for this purpose in the columns, and which concurrently define the elevational positions of the cables on supports. In the first prestressing stage, once the mortar has hardened on the joints, the linear cables are tensioned so as to avoid the occurrence of friction. The next stage of prestressing is effected, while the cables are still free and accessible in each channel, by means of a jack which vertically presses the cables in the middle or along any other location in each span, until the cables are lowered below the hole in the column so as to enable a steel tube which is adapted to fix the position of the lowered cables to be put into place.

1 Claim, 8 Drawing Figures

PRECAST SKELETON SPATIAL MONOLITHIC STRUCTURE

FIELD OF THE INVENTION

The present invention relates to the construction of a concrete precast skeleton monolithic structure and, more particularly, a structure wherein spatial unity is attained through the prestressing of steel cables employed therein.

DISCUSSION OF THE PRIOR ART

The industrialization progress in building with reinforced concrete demands the utilization of the simplest manner of prefabricating and assembling the skeleton structure. The most difficult problems encountered here relate to the joints of the skeleton structure. The problem in forming satisfactory joints has previously been solved in various ways such as, for example, by means of concrete or steel cantilevers extending columns; allowing the reinforcement to project from columns, and then concreting the joints, the foregoing of which is a rather slow procedure. The problem of forming connections and joints becomes still more complex when it involves structure in three dimensions. Furthermore, each prefabricated structure must comply with the conditions of a proper spatial unity in each direction thereof, in effect, it is necessary to achieve a sound degree of unity or connection of the skeleton structure although it may be precast, with this requisite not easily solved in a simple and economic manner.

A technique of prestressing the concrete in structures which are constructed only of prefabricated parts, and in which the joints thereof are exclusively formed on the principle of friction caused by the force of the prestressing has in recent years been extensively utilized. The concept of using prestressed joints predicated on friction has been widely applied in the field of bridge building. Also known are skeleton structures where the joints are exclusively constructed on the principle of friction generated by prestressing of the joints. However, since each skeleton structure generally consists of numerous spans extending in transverse and longitudinal directions, the main load-bearing parts, such as the beams, statically act as continuous supports with variable positive and negative moments being generated in each span. Until the present, the solution which had been sought lay in the prestressing of the skeleton structure by means of straight-line or linear cables which, although essentially correct, is not always an optimum manner of prestressing imposing limitations on the possibility of applications and providing shortcomings regarding both the statical bearing ability and economics of the structures.

Thus, when the cables are bent so as to enable the force of prestressing to follow the moment line with a variable index, there occurs an increasing degree of friction, and losses in the force of prestressing during the course of tensioning. In continuous beams having three spans it is almost unacceptable to use cables with fractured or segmented axes, and if such is the case, while entailing considerable economic losses; for four or more spans the degree of friction is increased to such extent whereby an adequate amount of prestressing becomes virtually impossible.

SUMMARY OF THE INVENTION

It is an object of the present invention, by applying the well-known maxim of the prestressed joint, to provide a solution to the complex problem of prestressing a precast skeleton structure in a simple manner, irrespective of the number of spans, and with no friction losses being encountered upon prestressing.

The foregoing is attained in that each beam, in the longitudinal and transverse directions thereof, is on one side divided into two channel-forming parts, thus providing ample space for the free threading of steel cables in order to effect the prestressing. The straight-line or linear cables run through the thus formed longitudinally and transversely extending channels, while in the locations for columns they are pulled through suitable holes previously prepared for this purpose in the columns, and which concurrently define the elevational positions of the cables on supports. In the first prestressing stage, once the mortar has hardened on the joints, the linear cables are tensioned so as to avoid the occurrence of friction. The next stage of prestressing is effected, while the cables are still free and accessible in each channel, by means of a jack which vertically presses the cables in the middle or along any other location in each span, until the cables are lowered below the hole in the column, so as to enable a steel tube, which is adapted to fix the position of the lowered cables to be put into place.

BRIEF DESCRIPTION OF THE DRAWINGS

These and other objects, features and advantages of the present invention will become more obvious from the following detailed description, taken in conjunction with the accompanying drawings, which show preferred embodiments of the present invention, and wherein.

DETAILED DESCRIPTION

Figure 1:
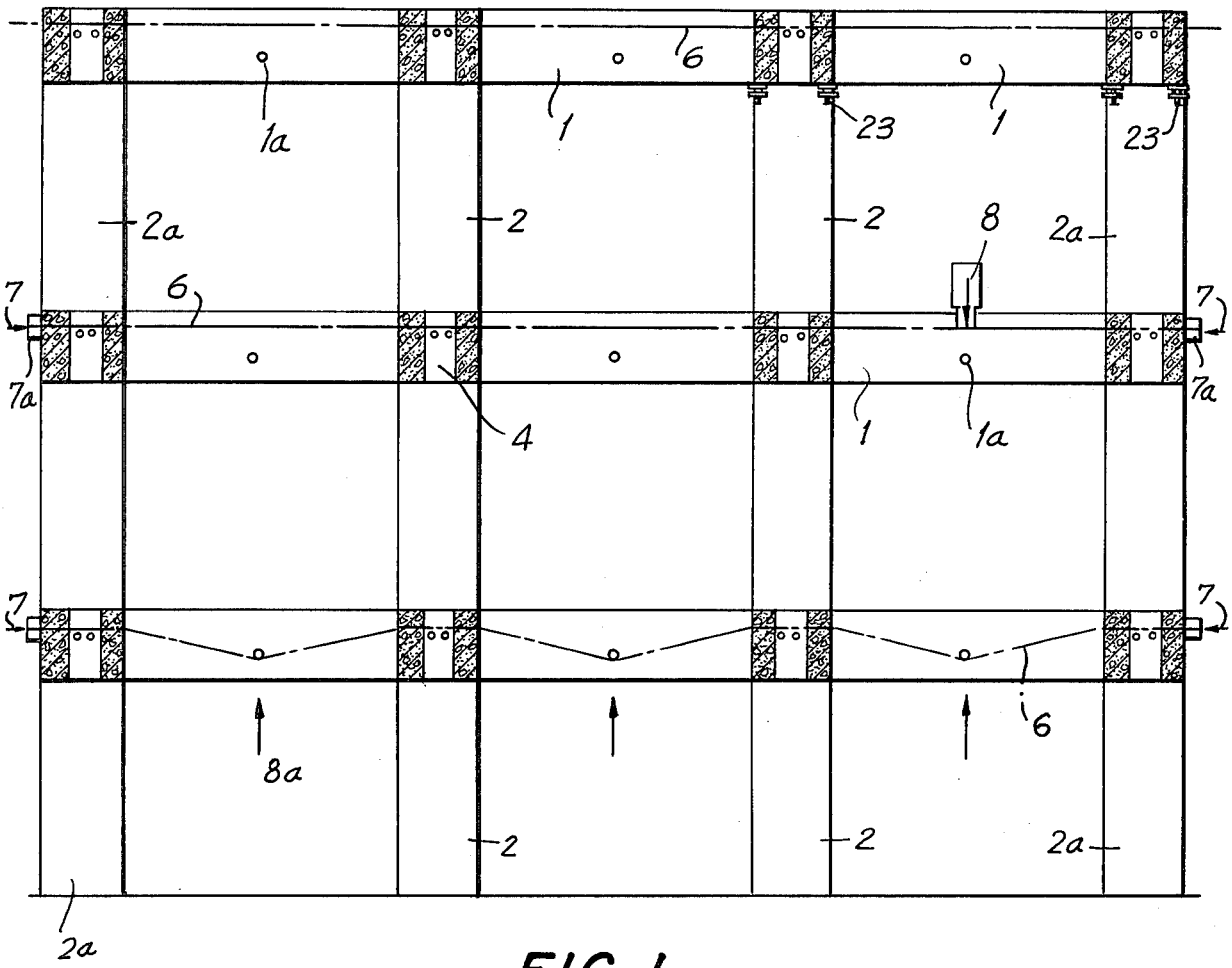
FIG. 1 is a generally schematic elevational cross-sectional view of a skeleton monolithic structure with two-piece beams.
Figure 2:
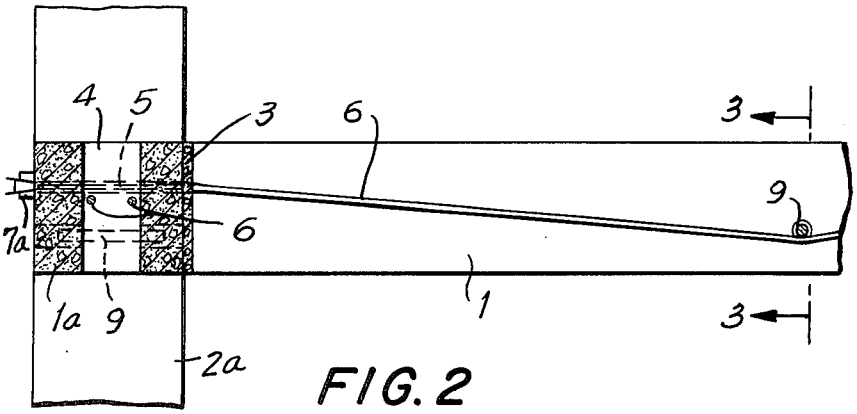
FIG. 2 is a horizontal cross-sectional view, on an enlarged scale, of a joint between beams and a column of the structure of FIG. 1.
Figure 3:
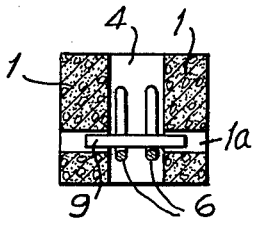
FIG. 3 is a section taken along line B—B in FIG. 2.

The precast skeleton monolithic structure, as shown in FIGS. 1 to 3, consists of reinforced concrete prefabricated elements, including center columns 2 and outer or end columns 2*a*, with most of the height extending through three floors, but which may be either higher or lower. Cross-holes extending through columns 5 are located at the level of floor slabs to be used in the structure. A beam 1 having a length which equals the distance between the columns, less the width of mortar 3 at the junction between column and beam, consists of two equal prefabricated portions 1 positioned so as to leave therebetween a free channel 4 for threading cables. There are formed one or more through-holes 1*a* in each of the portions 1.

The prestressing is carried out in two stages by means of steel cables 6 which extend through channels 4 and suitable through-holes 5 formed in the columns. First, the cables are positioned in a straight line by stretching them from the opposite ends with a horizontal force 7 and then anchoring them with anchors 7*a*, and second, by applying a vertical jack pressure 8 to the cables 6 at one or more spots and subsequently positioning tubes 9 in the holes 1*a*.

Figures 4, 5, 6, 7, 8:
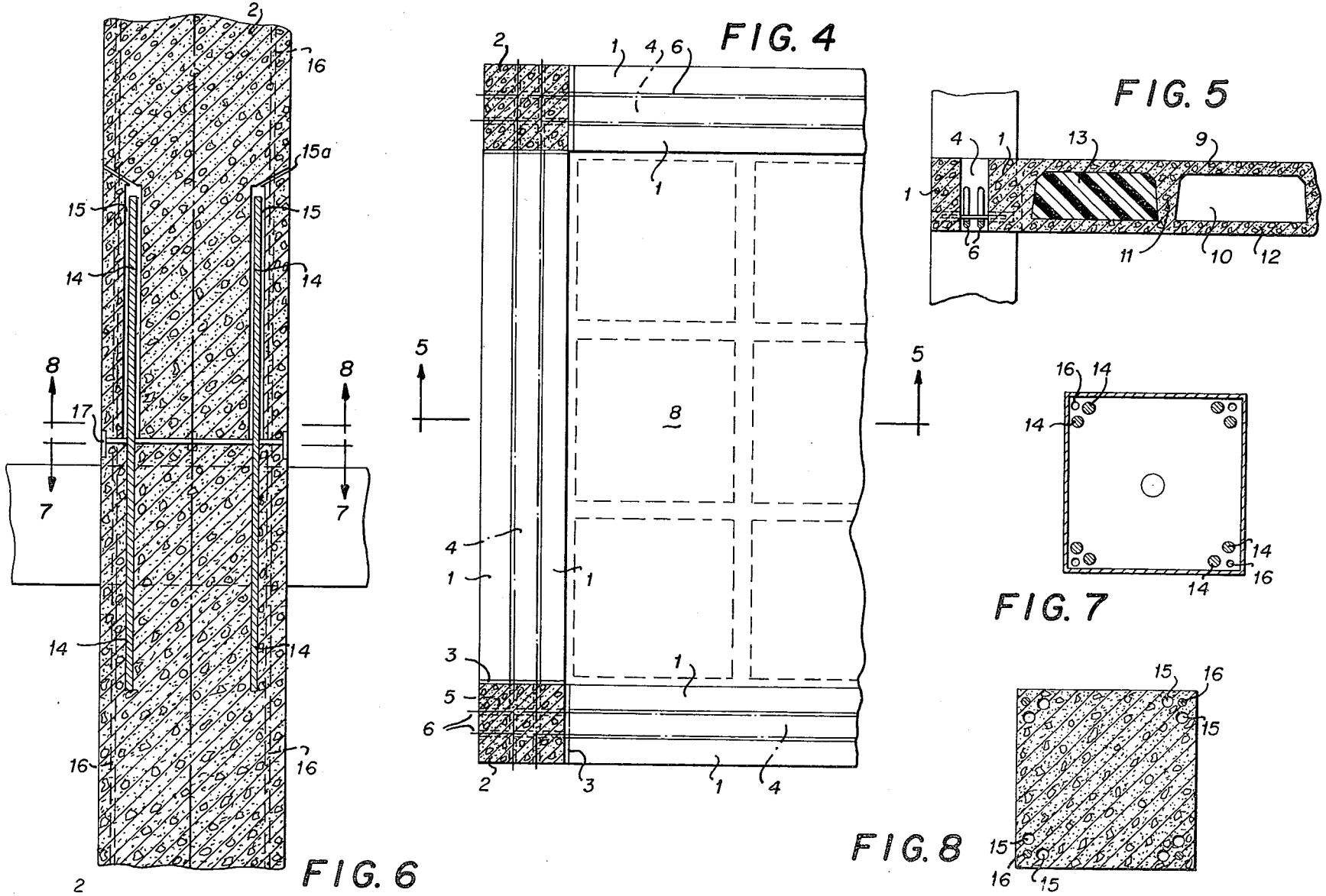
FIG. 4 is a plan view of a part of the span having two-piece beams.
FIG. 5 is a transverse cross-sectional view of ribbed floor slab.
FIG. 6 is an enlarged fragmentary detail of a column joint.
FIGS. 7 and 8 are sections taken along, respectively lines G—G and H—H in FIG. 6 in plan view.

FIG. 4 shows a part of plan view including cross sections of columns 2, upper views of two-part beams 1, channels 4, cables 6, through-holes 5, and floor slab structure.

FIG. 5 shows the cross section C—C of the FIG. 4 presenting a cross-ribbed type floor slab structure including upper slab, voids 10, rib 11, and lower slab 12. The structure may be precast through use of light bodies 13 forming the voids in the slab. Other species of ribbed floor structures may be used.

FIGS. 6–8 show a structure of a typical column joint. Each column 2 or 2*a* has bars 14 extending out from one side thereof and holes 15 in the other side. Two bars 14 at each angles for overlapping of the reinforcement 16 may project either upwardly or downwardly. The upper part of the column may be equipped with a sheet frame 17. The openings 15*a* remain at the ends of holes 15 for facilitating injecting therethrough of the connecting agent.

The invention enables, not only the prestressing to be performed with no friction losses, but also facilitates an additional saving of the prestressing steel. In other words, within each prestressed concrete structure, due to shrinkage and creeping, there occur losses in the initial prestressing force of approximately 20 per cent, and which must be directly compensated for by a proportional increase in the amount of steel used. The invention enables these losses to be decreased, since by the lowering of the cables there is effected an additional elongation, and consequently an additional stressing in the steel which directly permits a saving in the steel.

FIG. 2 clearly shows that the joint between the columns and beams is solely effected by contacting the front part or end of the beam with the columns sides. Upon stretching the cables which extend through the columns, the front parts of the beams are permanently pressed against the columns by the forces of prestressing which are multiple times larger than the maximal vertical reactions. This in itself indicates that the stability of this simple joint structure considerably exceeds the degree of stability which may be achieved in other parts of the structure. In even simpler terms, the beam or column will fracture more readily than the joint itself as has been proven by numerous statical experimental tests.

Dynamic tests of the joints have indicated a high degree of stability, even in the case of horizontal shifts of the skeleton structure. The tests have evidenced an exceptionally desirable characteristic of the prestressed joint in the event of a destructive earthquake. When the deformations are exceeded, the joint is plastified and enables exceeding of the deformation without any damage thereto. Once the earthquake is over, the joint reverts to its original stage.

Predicated upon the above description, the conceptional solution of the precast space skeleton does not depend upon the use of secondary structures on the floor slab. This means that the invention renders possible the formation of the secondary floor structures in various ways, and of different material. The secondary floor structures are used for filling the framed space between beams and their assembly may be subsequently effected while leaning on the already mounted beams or the secondary elements of the floor may be connected with beams during the course of precasting and then mounted together therewith. If the floor slab is made as a full, straight, spatial beam, it may — depending upon need, be leveled with the upper or bottom edge of the beam. A ribbed concrete floor or a ribbed floor with different elements of a light material very often represents a more convenient solution.

In all of the aforementioned cases the most important point lies in that the connection between beams and the secondary structure of floor slabs is effected by means of a partial prestressing. Namely, initial prestressing is conveyed to the columns via the beams, but due to the shrinkage and creeping of concrete it is partially transmitted to the connection between the beams and secondary structures, so as to encircle the secondary structures in a hoop.

While there has been shown what is considered to be the preferred embodiment of the invention, it will be obvious that modifications may be made which come within the scope of the disclosure of the specification.

What is claimed is:

1. A skeleton precast space monolithic structure including a system of reciprocal orthogonal beams connected to a plurality of vertical columns by frontal contact between the ends of the beams and sides of the columns, comprising: said beams being formed so as to provide longitudinal interspaces, at least one transverse opening extending through each of said beams, through-holes extending through said columns in axial alignment with said beam interspaces, horizontally prestressed linear steel cables being anchored to the outermost columns of said structure and extending through the through-holes in said columns and said interspaces in said beams, means for deflecting said steel cables vertically downwardly in said interspaces to below the levels of said transverse openings in said beams so as to impart vertical forces thereto, said means including cable retaining means extending through said transverse openings; a sheet metal frame being supported proximate the upper end of each column, said frame having two bars extending vertically therefrom at opposite angles thereto, column reinforcements being connected to said bars, said bars entering apertures in said columns, and connecting agent being injected into said apertures to form a rigid fastening bond therebetween.

* * * * *